United States Patent [19]

Chi-Shuang

[11] Patent Number: 4,901,768

[45] Date of Patent: Feb. 20, 1990

[54] PICKING APPARATUS FOR A LOOM

[76] Inventor: Huang Chi-Shuang, No. 23, Lane 235, Kai-San Rd., Tainan, Taiwan

[21] Appl. No.: 345,007

[22] Filed: Apr. 28, 1989

[51] Int. Cl.[4] ..... D03D 49/44

[52] U.S. Cl. ..... 139/134

[58] Field of Search ..... 139/133, 134, 142

[56] References Cited

U.S. PATENT DOCUMENTS

| | | | |
|---|---|---|---|
| 2,713,876 | 7/1955 | Walton | 139/134 |
| 4,762,153 | 8/1988 | Chuang et al. | 139/134 |

FOREIGN PATENT DOCUMENTS

| | | | |
|---|---|---|---|
| 211916 | 7/1909 | Fed. Rep. of Germany | 139/134 |
| 1033191 | 7/1953 | France | 139/134 |

*Primary Examiner*—Henry S. Jaudon

*Attorney, Agent, or Firm*—Lackenbach Siegel Marzullo & Aronson

[57] ABSTRACT

A picking apparatus includes a sley with a reed assembly fixed thereon, a raceway formed in the upper surface of the sley, a magnetic force-generating device for generating a magnetic force which moves along the raceway, and a shuttle which is attracted by the magnetic force so as to fly along the raceway. The sley has a slot formed therein along the raceway. The shuttle has an engagement hole. The magnetic force-generating device has an extendable and retractable gripping unit which can retract into the engagement hole of the shuttle immediately after the completion of a picking motion. Therefore, the magnetic force-generating device can attract and drive the shuttle during the picking motion. It can be appreciated that the gripping unit can interlock the shuttle and the magnetic force-generating device from the time of the completion of a picking motion until the time of the commencement of the next picking motion.

8 Claims, 7 Drawing Sheets

PICKING APPARATUS FOR A LOOM

BACKGROUND OF THE INVENTION

This invention relates to a picking apparatus for a loom, more particularly to a picking apparatus including a movable magnetic force-generating means which drives the shuttle to fly along a raceway.

Conventional magnetic shuttle looms such as those disclosed in U.S. Pat. Nos. 4,762,153, 4,529,016 and 2,630,839 have a magnetic force-generating means which drives the shuttle to move across a sley so as to proceed with a picking motion. It is necessary for conventional looms to maintain accurate and synchronous movement of the shuttle with a moving, magnetic force-generating means. Otherwise, the picking motion cannot be controlled accurately. Therefore, the magnetic force-generating means requires a large magnetic force, thereby increasing the cost and difficulty of manufacturing such an apparatus as well as the frictional resistance and wear caused between the shuttle and the sley thereof. Because the inertial resistance of the shuttle and the magnetic force-generating means produces torque when started, it is also difficult to obtain the synchronous movement thereof. Furthermore, when the magnetic force-generating means stops, the shuttle continues to move and cannot be attracted by the magnetic force-generating means due to the fact that difference between the weight of the shuttle and the magnetic force-generating means creates different inertial forces while said shuttle and said means are moving. As a result, the loom may be damaged or may malfunction and the operator may be hurt. In addition, the higher the speed of these members, the greater is the inertial force thereof. Therefore, the picking speed thereof is limited, preventing the operation efficiency of the loom from being increased.

SUMMARY OF THE INVENTION

It is therefore the object of this invention to provide a picking apparatus for a magnetic shuttle loom which accurately synchronizes a shuttle and a magnetic force-generating means of a loom.

To achieve the above object, a picking apparatus is provided which includes a sley with a reed assembly fixed thereon, a raceway formed in the upper surface of the sley, means for generating a magnetic force which moves along the raceway, and a shuttle which is attracted by the magnetic force so as to fly along the raceway. The sley has a slot formed therein along the raceway. The shuttle has an engagement hole. The magnetic force-generating means has an extendable and retractable gripping means which can extend into the engagement hole of the shuttle immediately after the completion of a picking motion. Therefore, the magnetic force-generating means can attract and drive the shuttle during the picking motion. It can be appreciated that the gripping means can interlock the shuttle and the magnetic force-generating means from the time of the completion of a picking motion until the time of the commencement of the next picking motion.

BRIEF DESCRIPTION OF THE DRAWINGS

This and other objects, features and advantages of this invention will become apparent in the following detailed description of a preferred embodiment of this invention, in which.

DETAILED DESCRIPTION OF THE PREFERRED EMBODIMENT

Figure 1:
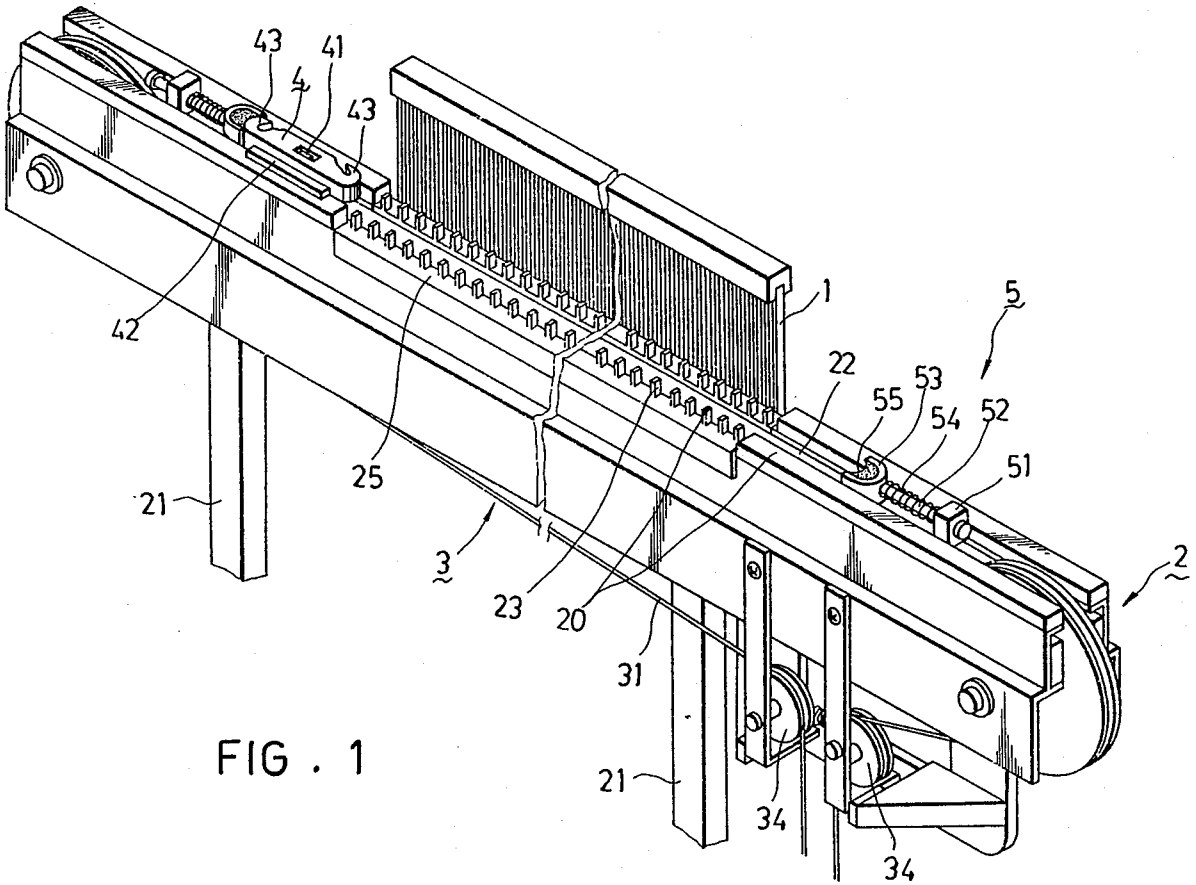
FIG. 1 is a partially perspective view of an embodiment according to this invention.

FIG. 1 is a partially perspective view showing an embodiment of this invention. As illustrated, this embodiment includes a reed assembly 1 fixed on a sley 2, a raceway 20 disposed on the upper surface of the sley 2, a magnetic force-generating means 3 producing a magnetic force which moves along the raceway 20, a shuttle 4 which is attracted by the magnetic force created by the magnetic means 3 to fly along the raceway 20, and two cushioning devices 5 disposed at two ends of the raceway 20.

Because the sley 2 is connected by means of links 21 to a conventional beating means (not shown), it can be driven to swing along with the reed assembly 1 so as to proceed a beating motion. The sley 2 consists of two beams which are spaced apart from each other at a predetermined distance to define a slot 22 therebetween. A recess 25 is formed in the sley 2 in alignment with the reed assembly 1. A plurality of equally spaced-apart protrusions 23 are fixed in the recess 25 and have upper surfaces which are flush with the upper surface of the sley 2.

The raceway 20 is constructed of the upper surfaces of the sley 2 and the protrusion 23. The shuttle has a hole 41 formed therethrough, two lengthwise extending wings 42 projecting from two sides thereof, and a hooking portion 43 disposed at two ends thereof so as to hold yarn. The wings 42 of the shuttle 4 are supported on the beams of the sley 2 in such a manner that the hole 41 of the shuttle 4 is aligned with the slot 22 of the sley 2. The magnetic means 3 is adapted to create a magnetic force which reciprocates along the raceway 20. In particular, the magnetic means 3 includes an endless rope 31, a magnet 32 secured to the endless rope 31, two pulleys 33 which tauten the endless rope 31 along the raceway 20 so that the endless rope 31 can circulate, a driving mechanism 6 driving the endless rope 31 to circulate reciprocately in alternate clockwise and counterclockwise directions so as to reciprocate the magnetic means 3 under the raceway 20, and a stretcher 34 interposed between the driving mechanism 6 and the pulleys 33 so as to maintain the tautened condition of the endless rope 31 when the rotational direction thereof is changed.

When proceeding a picking motion, the driving mechanism 6 drives the endless rope 31 to pass over the stretcher 34 and the pulleys 33 so that the endless rope 31 circulates reciprocately in clockwise and counterclockwise directions, thereby reciprocating the magnet 32 under the raceway 20. In this way, the shuttle 4 is attracted to reciprocate along the raceway 20.

A guideway 24 is formed in the sley 2 and includes a low portion 241 disposed under the raceway 20 so as to guide the magnet 32 to move, two high portions 242 disposed on both sides of the low portion 241 at a level slightly higher than that of the low portion 241, and two inclined portions 243 interconnecting the low portion 241 and the high portions 242.

Figure 3:
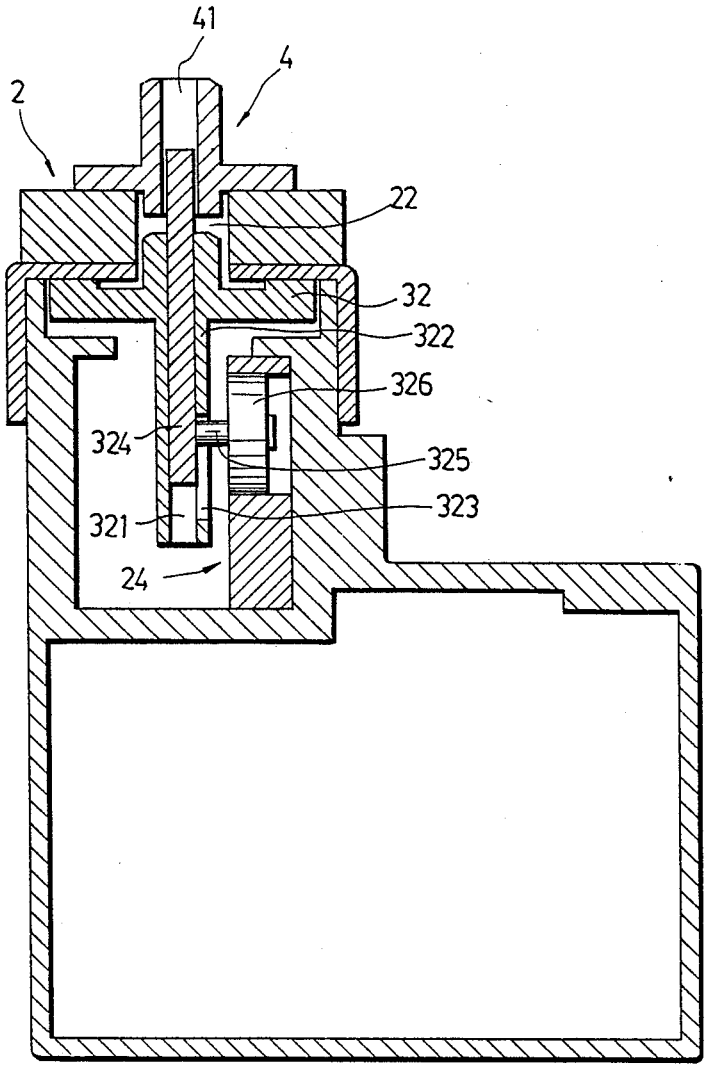
FIG. 3 is a schematic view illustrating how to lock a shuttle on a magnetic force-generating means in accordance with this invention.

Referring to FIG. 3, with the slot 22 formed in the sley 2, the reduction of the magnetic force between the shuttle 4 and the magnetic means 3 is minimized.

The magnet 32 includes a hole 321 formed therethrough in alignment with the hole 41 of the shuttle 4, a guide tube 322 disposed through the hole 321 forming a channel for a gripping rod 324, and an axially extending slot 323 aligned with the guideway 24. A pin 325 extends from the gripping rod 324 into the slot 323. A guide roller 326 is mounted on the end of the pin 325 and disposed slidably in the guideway 24. The guide roller 326 moves with the magnet 32 along the guideway 24 so as to extend out from and retract into the channel formed by the hole 321 and the guide tube 322 due to the fact that the guideway 24 has high and low portions. After a picking motion is finished, the gripping rod 324 retracts into the hole 41 of the shuttle 4.

Figure 4:
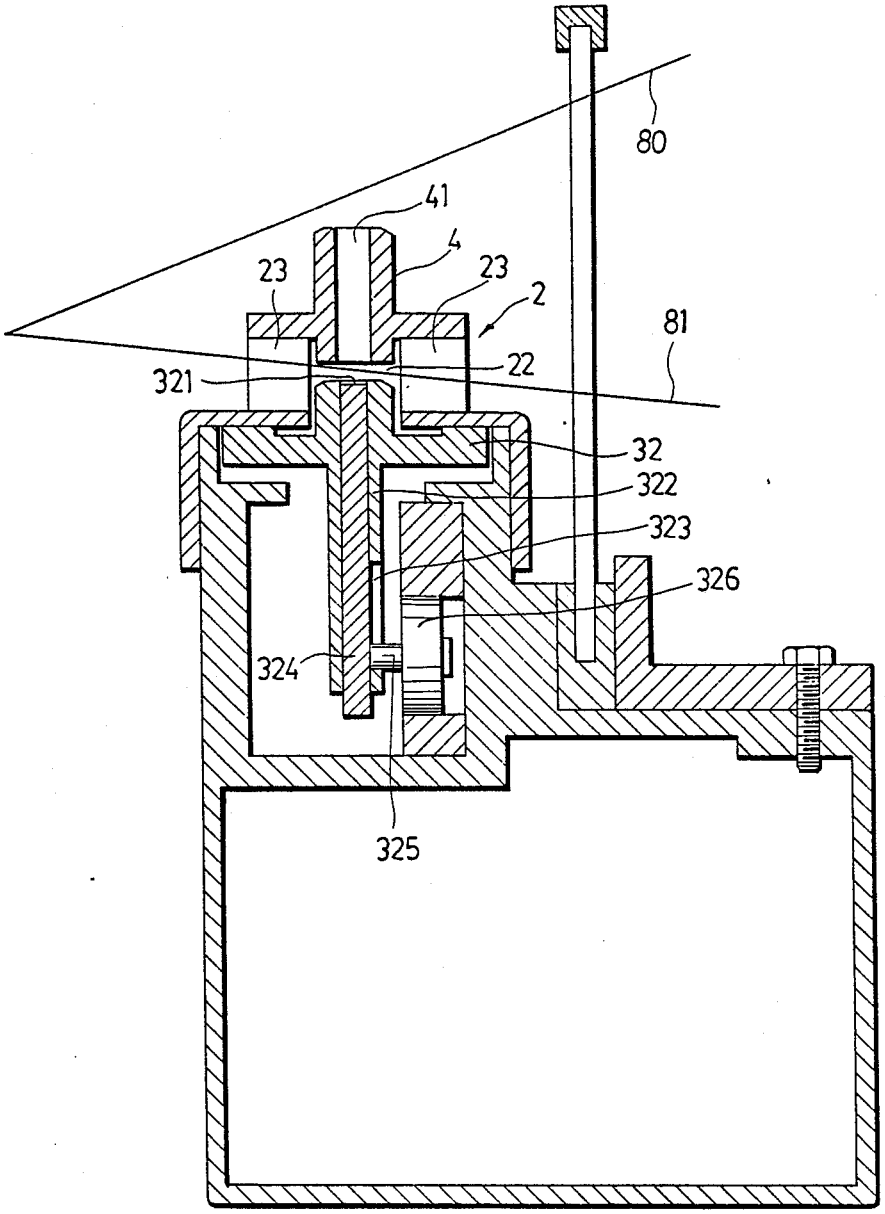
FIG. 4 is schematic view illustrating how to unlock the shuttle from the magnetic force-generating means in accordance with this invention.

Referring to FIG. 4, although the shuttle 4 is released from the gripping rod 324 during the picking motion, it is still attracted by the magnet 32 to move along the raceway 20 so as to pass into the shed formed by the yarn 80, 81. Because the lower layer of warp yarn 81 extend between the protrusions 23, the shuttle 4 cannot hit the strands thereof.

Figure 2:
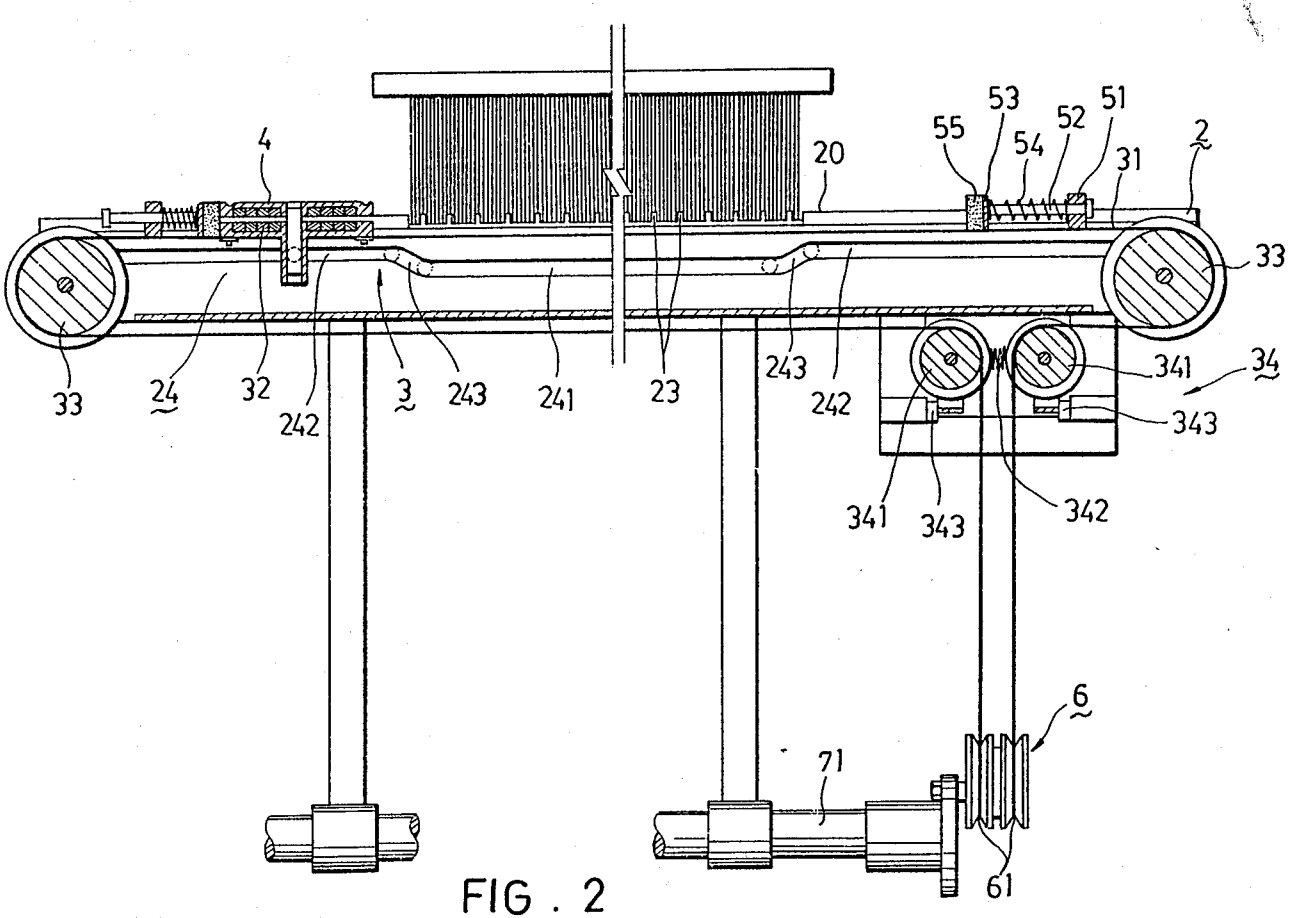
FIG. 2 is a schematic side view showing the structure of the embodiment.

Referring to FIGS. 1 and 2, the cushioning device 5 includes two fixed seats 51 respectively disposed on two end portions of the raceway 20. Two rods 52 are supported on the fixed seats 51 and can move along the slot 22. Each of the rods 52 has a stop 53 disposed at the inner end thereof. The stop 53 includes a cushioning pad 55 disposed at the end surface thereof. A resilient means, such as a compression spring 54, is installed between the stop 53 and the fixed seat 51 so as to absorb the inertial force of the shuttle 4 and the magnet 32 when halted. The elastic repulsion of the resilient means facilitates the starting of the shuttle 4 and the magnet 324.

Figure 5:
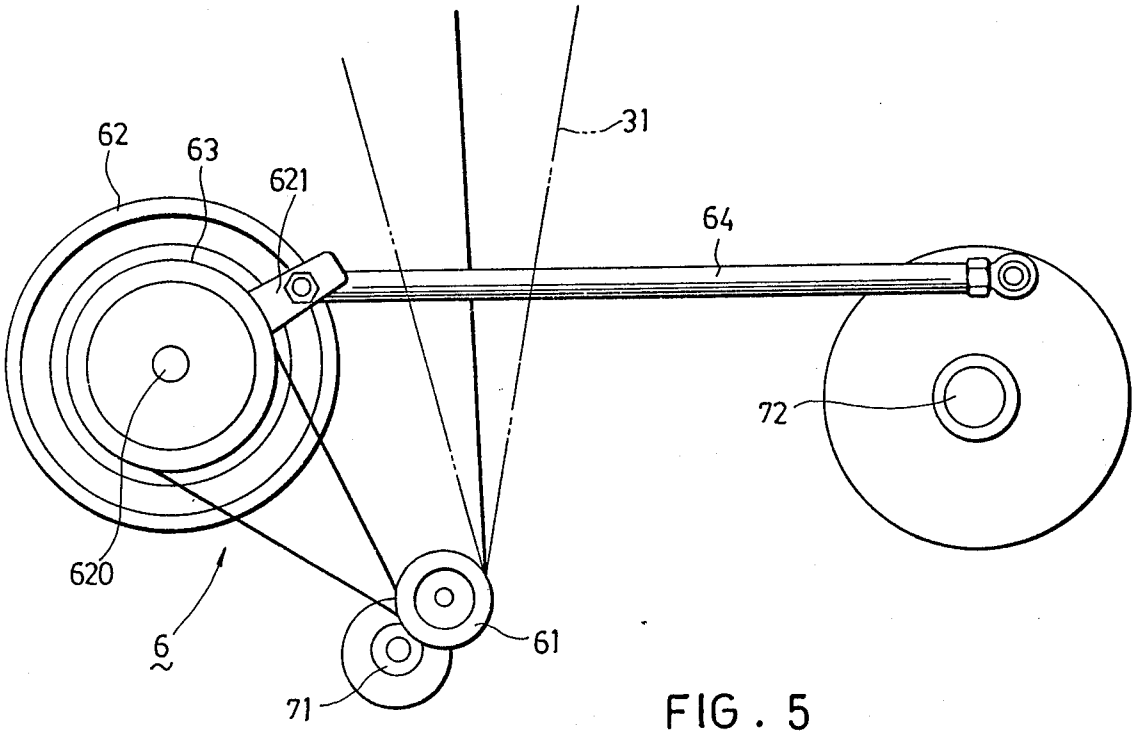
FIGS. 5–7 are schematic views illustrating the driving mechanism of the embodiment according to this invention.
Figure 6:
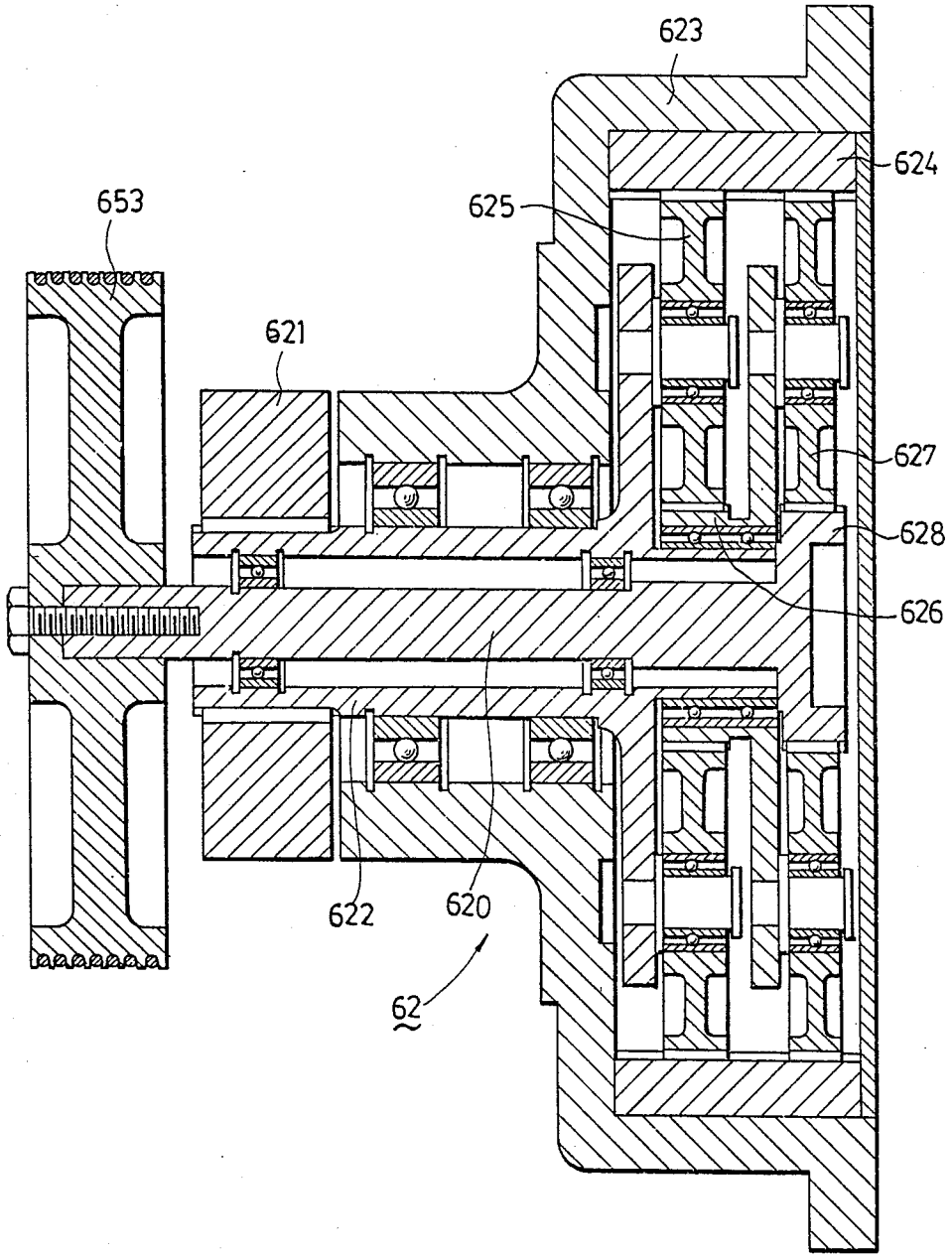
Figure 7:
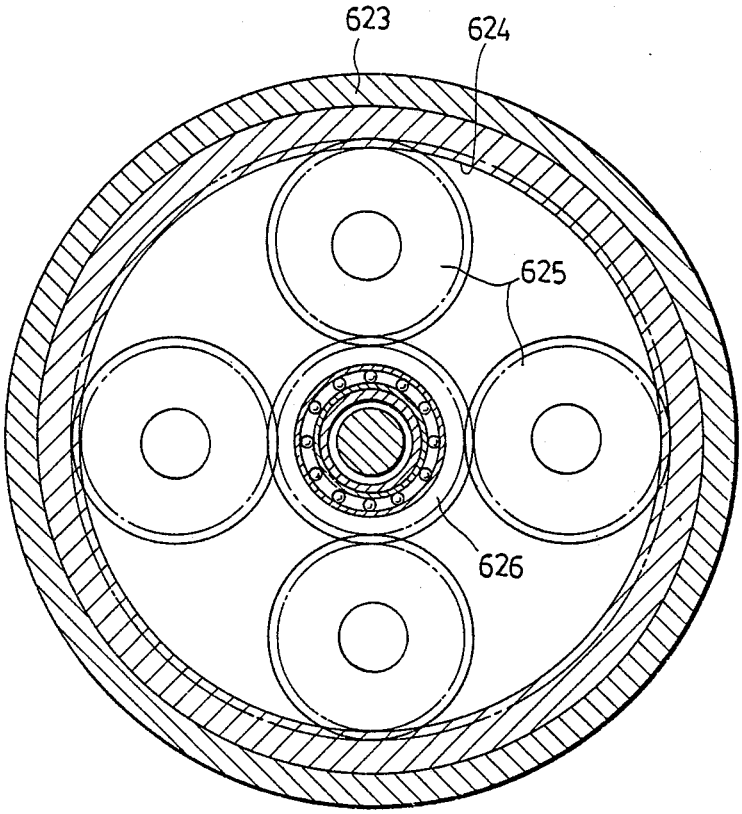

The driving mechanism 6 is illustrated in FIGS. 5–7. Referring to FIGS. 1, 2 and 5, the driving mechanism 6 includes two compensation pulleys 61 disposed in proximity to the swing shafts 71 of the beating means; a speed change unit 62 with a planetary gear train disposed in an appropriate position on the frame of the loom so as to provide an increased speed output; a rope pulley 63 secured to the output shaft 620 of the speed change unit 62; and a link 64 connected pivotally to the input plate 621 at one end thereof and to a main rotating shaft 72 at the other end of the link 64.

Because the link 64 is eccentrically connected to both the input plate 621 and the main rotating shaft 72, the input plate 621 can swing within a selected range so as to rotate the rope pulley 63 at a speed greater than that of the main rotating shaft 72 in alternate clockwise and counterclockwise directions by the speed change unit 62.

The rope 31 is wound on the rope pulley 63 and has one end which extends around the right compensation pulley 61 shown in FIG. 2. The end of the rope 31 is passed in turn through the stretcher 34, the right pulley 33, the sley 2, the left pulley 33, the stretcher 34 and the left compensation pulley 61 to couple with the other end of the rope 31 at the rope pulley 63 so as to form an endless rope. The magnet 32 is carried on the endless rope 31 so as to reciprocate and attract the shuttle 4 so that the shuttle 4 also reciprocates along the raceway 20.

Referring to FIG. 5, when proceeding with the picking motion, the rope 31 is swung along with the sley 2 causing the length of the rope 31 to change depending on the change of position. To eliminate this drawback, the compensation pulleys 61 are therefore provided in eccentrical positions on two sides of the swing shafts 71. When swung, the positions of the axes of the compensation pulleys 61 are changed so as to vary the distance between the rope pulley 63 and the compensation pulleys 61, thereby compensating for the length of the rope 31.

Again referring to FIGS. 1 and 2, the stretcher 34 includes two tension pulleys 341 disposed under the sley 2, a tension spring 342 interconnecting the tension pulleys 341, and two stops 343 disposed on the outer sides of the tension pulleys 341.

Because the rope 31 extends between the tension pulleys 341 and pushes the same outward, the spring 342 has a potential force for pulling the tension pulleys 341 inward. When the portion of the rope 31 passing over either of the tension pulleys 341 is loosened, the latter is pulled inward by the spring 342 so as to obviate this slackness.

Referring to FIGS. 6 and 7, the input plate 621 of the speed change unit 62 is disposed on the end portion of the input shaft 622. The casing 623 of the speed change unit 62 is fixed on the frame of the loom. The casing 623 includes a ring gear 624 fixed on the inner surface thereof. A plurality of planetary gears 625 are disposed on the input shaft 622 and mesh with both the ring gear 624 and the sun gear 626. The end extension of the sun gear 626 is provided with a plurality of planetary gears 627 which mesh with both the ring gear 624 and the output gear 628 which is disposed on the end of the output shaft 620. Because bearings are provided between the output shaft 620 and the sun gear 626 and between the output shaft 620 and the input shaft 622, the output shaft 620 can rotate independently of both the sun gear 626 and the input shaft 622. Due to the fact that the tooth number of the ring gear 624, the planetary gears 625 and the sun gear 626 is different, when the planetary gears 625 drive the sun gear 626 and the planetary gears 627 drive the output gear 628, a high-speed swinging movement is output at the end of the speed change unit 62 to which a rotation is input. With the output shaft 620 extending through the tubular input shaft 622, motion can be input and output at the same ends of the shafts 620, 622 so as to reduce the volume of the loom. Because the planetary gear 627 meshes with the sun gear 626 which is mounted rotatably on the input shaft 622 by bearings, the planetary gears 627 are positioned in the speed change unit 62 so as to avoid wear on the ring gear 624, thereby increasing the life of the speed change unit 62.

As explained in the foregoing, the picking apparatus of this invention includes a sley with a reed assembly fixed thereon; a raceway formed in the upper surface of the sley; means for generating a magnetic force which moves along the raceway; and a shuttle which is attracted by the magnetic force to fly along the raceway. The sley has a slot formed therein along the raceway. The shuttle has an engagement hole. The magnetic force-generating means has an extendable and retractable gripping means which can retract into the engagement hole of the shuttle immediately after a picking motion has been completed.

Therefore, the magnetic force-generating means can attract and drive the shuttle to move during the picking motion. It can be appreciated that the gripping means can interlock the shuttle and the magnetic force-generating means from the time of the completion of a picking motion until the time of commencement of the next picking motion. By these means, the phenomena of inaccurate synchronization and derailment are therefore eliminated.

With this invention thus explained, it is apparent that numerous modifications and variations can be made without departing from the scope and spirit of this invention. It is therefore intended that this invention be limited only as indicated in the appended claims.

I claim:

1. A picking apparatus for a loom comprising:
a sley with a reed assembly fixed thereon;
a raceway formed in an upper surface of said sley;
means for generating a magnetic force which moves along said raceway; and
a shuttle attractable by said magnetic force to fly along said raceway;
wherein said sley has a slot formed therein along said raceway, said shuttle having an engagement hole, said magnetic force-generating means having an extendable and retractable gripping means which can retract into said engagement hole of said shuttle immediately after a picking motion has been finished.

2. A picking apparatus as claimed in claim 1, wherein said sley has a guideway formed therein, said guideway having a low portion guiding said magnetic force-generating means to move so that said shuttle can effect a picking motion, two high portions positioned on both sides of said low portion, and two inclined portions interconnecting said low portion and said high portions, said magnetic force-generating means including a guide roller movable along said guideway so as to extend and retract said gripping means.

3. A picking apparatus as claimed in claim 1, wherein said magnetic force reciprocates along said raceway, said sley including two fixed seats secured thereto near two ends of said raceway, two cushioning devices respectively mounted on said fixed seats so as to absorb inertial force of said shuttle when said shuttle starts and stops at the ends of said raceway, and two rods respectively supported on said fixed seats and slidable along said raceway, each of said rods including a stop with a cushioning pad attached to an end surface of said stop, and a resilient means disposed between said fixed seat and said stop.

4. A picking apparatus as claimed in claim 1, wherein said magnetic force-generating means includes a tautened endless rope having a portion which moves under said raceway, a magnet secured to said endless rope, and a driving mechanism activating said endless rope to circulate reciprocately in alternate clockwise and counterclockwise directions.

5. A picking apparatus as claimed in claim 4, wherein said loom has a main rotating shaft mounted rotatably thereon, said driving mechanism including a speed change unit fixed on said loom and having a rotatable input plate and a rotatable output shaft, a rope pulley sleeved rigidly on said output shaft, and a link connected pivotally and eccentrically to said input shaft at one end thereof and to said main rotating shaft at the other end thereof, said endless rope having several turns wound on said rope pulley, whereby, said input plate can swing within a selected range so as to rotate said rope pulley at a speed greater than that of said main rotating shaft in alternative clockwise and counterwise directions by said speed change unit.

6. A picking apparatus as claimed in claim 5, wherein said loom includes a beating means with two swing shafts, said driving mechanism including two compensation pulleys fixed on said loom in proximity to said swing shafts so that said endless rope extends around said compensation pulleys, said compensation pulleys being provided in eccentrical positions on two sides of said swing shaft, whereby, when swung, positions of axes of said compensation pulleys are changed so as to vary distance between said rope pulley and said compensation pulleys, thereby compensating for length of said rope.

7. A picking apparatus as claimed in claim 5, wherein said magnetic force-generating means includes a stretcher, said stretcher including two tension pulleys disposed under said sley, a tension spring interconnecting said tension pulleys, and two stops disposed on outer sides of said tension pulleys.

8. A picking apparatus as claimed in claim 5, wherein said speed change unit includes a casing fixed on said loom and a ring gear fixed on an inner surface thereof, a tubular input shaft journalled in said casing, an output shaft journalled within said input shaft, a sun gear sleeved on said output shaft, a plurality of planetary gears meshing with both said sun gear and said ring gear, and an output gear sleeved rigidly on said output shaft, said rope pulley being connected securely to an outer end of said output shaft.

* * * * *